US010443553B2

(12) United States Patent
Serra et al.

(10) Patent No.: US 10,443,553 B2
(45) Date of Patent: Oct. 15, 2019

(54) COUPLING DEVICE

(75) Inventors: Giandomenico Serra, Loc. Ghezzano-S. Giuliano Terme (IT); Francesco Mennella, Pisa (IT); Andrea Puccini, San Miniato (IT); Gisella Di Domizio, San Giuliano Terme (IT); Daniel Marc, Leghorn (IT)

(73) Assignee: CONTINENTAL AUTOMATIVE GMBH, Hannover (DE)

( * ) Notice: Subject to any disclaimer, the term of this patent is extended or adjusted under 35 U.S.C. 154(b) by 77 days.

(21) Appl. No.: 14/003,081

(22) PCT Filed: Feb. 29, 2012

(86) PCT No.: PCT/EP2012/053478
§ 371 (c)(1),
(2), (4) Date: Sep. 4, 2013

(87) PCT Pub. No.: WO2012/119912
PCT Pub. Date: Sep. 13, 2012

(65) Prior Publication Data

US 2013/0340714 A1 Dec. 26, 2013

(30) Foreign Application Priority Data

Mar. 4, 2011 (EP) ..... 11156964

(51) Int. Cl.
*F02M 55/02* (2006.01)

(52) U.S. Cl.
CPC ..... *F02M 55/025* (2013.01); *F02M 2200/855* (2013.01); *F02M 2200/857* (2013.01)

(58) Field of Classification Search
CPC .... F02M 69/465; F02M 55/025; F02M 61/14; F02M 2200/855; F02M 2200/857;
(Continued)

(56) References Cited

U.S. PATENT DOCUMENTS 3,527,263 A * 9/1970 Druzynski ..... F01L 1/12 123/470
4,813,834 A * 3/1989 Smith ..... B29C 70/74 411/337

(Continued)

FOREIGN PATENT DOCUMENTS

CN 1104568 C 4/2003
CN 1924344 A 3/2007

(Continued)

OTHER PUBLICATIONS

European Search Report, Application No. 11156964.6, 5 pages, dated May 19, 2011.

(Continued)

*Primary Examiner* — Lindsay M Low
*Assistant Examiner* — Omar Morales
(74) *Attorney, Agent, or Firm* — Slayden Grubert Beard PLLC

(57) ABSTRACT

The coupling device comprises a holding fixture being designed to be mechanically coupled to the fuel rail and comprising a through hole extending between a first surface and a second surface, the second surface opposing the first surface and being arranged and designed to face the cylinder head. Furthermore the coupling device comprises a fastening element being designed to be fixedly coupled to the cylinder head. The fastening element comprises a head portion and a shank portion. The head portion faces the first surface of the holding fixture and the shank portion is being partially arranged in the through hole and is designed to be in engagement with the cylinder head. In addition the coupling device comprises a retaining element being arranged inside the through hole, being coupled with the holding fixture, comprising in a given latch area a cross-section restriction and being in engagement with the shank (Continued)

Figure 1:
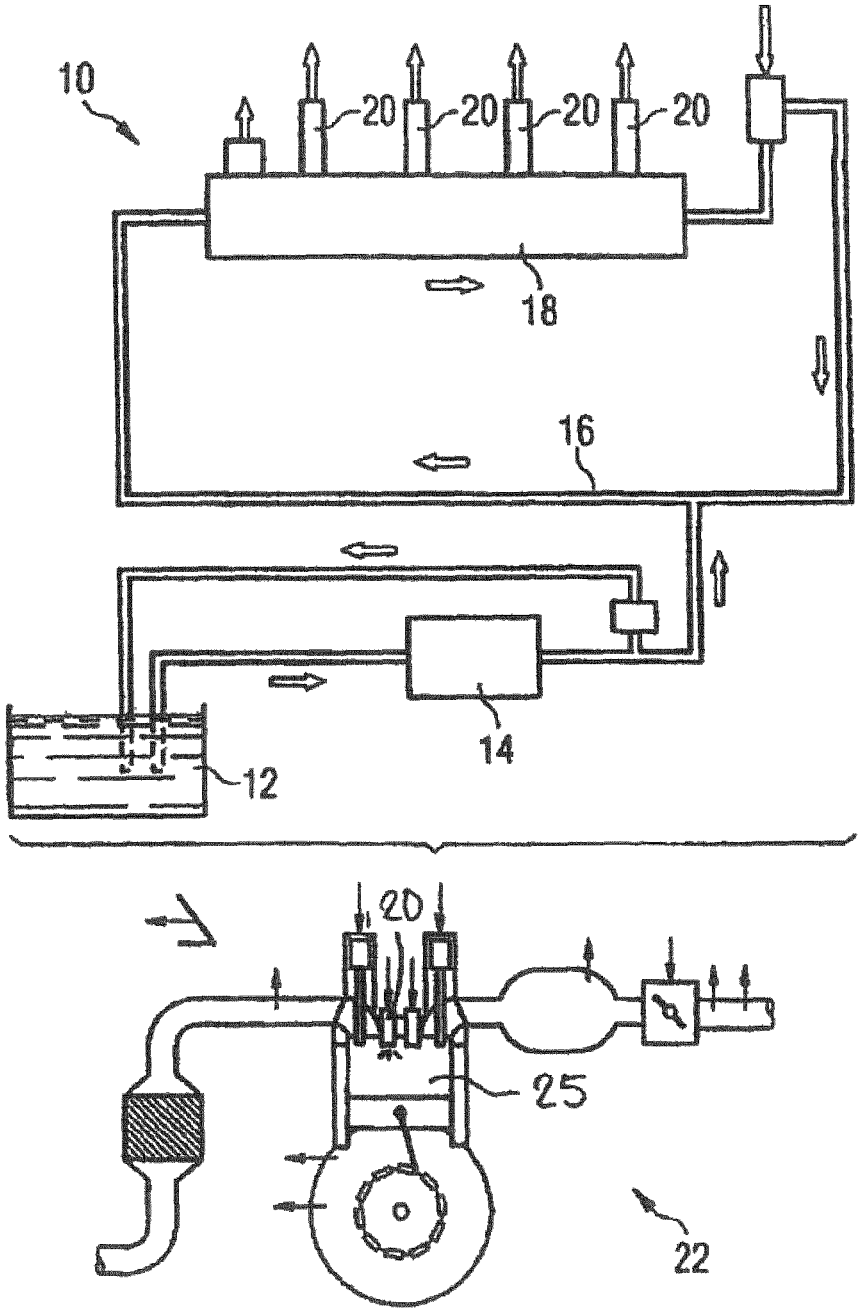

portion at least in this latch area. The retaining element is formed as a one-piece unit.

15 Claims, 5 Drawing Sheets

(58) Field of Classification Search
CPC ..... B29L 2023/003; F16B 37/0864; F16B 37/145; F16B 21/18; F16B 37/0857
USPC ..... 123/456, 469, 470
See application file for complete search history.

(56) References Cited

U.S. PATENT DOCUMENTS 4,975,008 A 12/1990 Wagner ..... 411/337
4,995,777 A * 2/1991 Warmington ..... F16B 19/05 411/361
5,090,852 A * 2/1992 Dixon ..... F16B 19/05 411/361
5,711,711 A * 1/1998 Schmidt, Jr. ..... F16B 41/002 470/41
5,807,052 A 9/1998 Van Boven et al. ..... 411/353
6,280,132 B1 * 8/2001 Szczukowski ..... F02F 7/006 411/107
6,872,040 B2 3/2005 Deeg et al. ..... 411/353
7,591,246 B2 * 9/2009 Beardmore ..... F02M 55/025 123/456
2007/0163545 A1 7/2007 Beardmore et al. ..... 123/456
2008/0075403 A1 * 3/2008 Holt ..... F02M 55/025 384/551
2010/0202856 A1 8/2010 Donovan et al. ..... 411/546

FOREIGN PATENT DOCUMENTS

DE 19916098 A1 10/2000
DE 102005002603 A1 10/2005
EP 0942164 A2 9/1999
EP 1353081 A1 10/2003
KR 19990007335 A 1/1999 ..... F16B 41/00
WO 2012/119912 A1 9/2012 ..... F02M 55/02

OTHER PUBLICATIONS

International Search Report and Written Opinion, Application No. PCT/EP2012/053478, 8 pages, dated Apr. 17, 2012.
Chinese Office Action, Application No. 201280011659.6, 16 pages, dated Feb. 17, 2015.
Korean Office Action, Application No. 2018036944236, 6 pages, dated May 31, 2018.
Korean Office Action, Application No. 20137026135, 6 pages, dated May 31, 2018.
Korean Notice of Allowance, Application No. 20137026135, 3 pages, dated Nov. 9, 2018.

* cited by examiner

COUPLING DEVICE

CROSS-REFERENCE TO RELATED APPLICATIONS

This application is a U.S. National Stage Application of International Application No. PCT/EP2012/053478 filed Feb. 29, 2012, which designates the United States of America, and claims priority to EP Application No. 11156964.6 filed Mar. 4, 2011, the contents of which are hereby incorporated by reference in their entirety.

The invention relates to a coupling device for mechanically coupling a fuel rail to a cylinder head of a combustion engine.

Coupling devices for mechanically coupling a fuel rail to a cylinder head of a combustion engine are in widespread use, in particular for internal combustion engines. Fuel can be supplied to an internal combustion engine by the fuel rail through a fuel injector. In order to keep pressure pulsation within the fuel rail at a very low level an isolated coupling of the fuel rail and the combustion engine is desired. The isolated coupling may be designed to attenuate the transmission of high frequency vibrations e. g. from the fuel rail to the respective attachment point, which is most likely the cylinder head.

Another aspect is that assembly technology in the automotive industry increasingly requires assembly units in which a plurality of components forms a pre-assembled unit. Realizing such assembly units allows for a great level of pre-manufacture.

The object of the invention is to create a coupling device for mechanically coupling a fuel rail to a cylinder head of a combustion engine which is simply to be manufactured and which facilitates a reliable and precise coupling between the fuel rail and the cylinder head.

The objects are achieved by the features of the independent claim. Advantageous embodiments of the invention are given in the sub-claims.

The invention is distinguished by a coupling device for mechanically coupling a fuel rail to a cylinder head of a combustion engine. The coupling device comprises a holding fixture being designed to be mechanically coupled to the fuel rail and comprising a through hole extending between a first surface and a second surface, the second surface opposing the first surface and being arranged and designed to face the cylinder head. Furthermore the coupling device comprises a fastening element being designed to be fixedly coupled to the cylinder head. The fastening element comprises a head portion and a shank portion. The head portion faces the first surface of the holding fixture and the shank portion is being partially arranged in the through hole and is designed to be in engagement with the cylinder head. In addition the coupling device comprises a retaining element being arranged inside the through hole, being coupled with the holding fixture, comprising in a given latch area a cross-section restriction and being in engagement with the shank portion at least in this latch area. The retaining element is formed as a one-piece unit.

This has the advantage that a fast and secure coupling of the fuel rail to the cylinder head is possible. The fastening element may be already located at the coupling device in a captive, aligned and pre-assembled way. Because of the retaining element the fastening element may be kept in position during transportation and service operation, which may allow a correct automatic assembly of the fuel rail and the cylinder head. Additionally a probability that the fastening element is disassembled because of an accidental collision with another environmental component, e. g. with a cylinder wall, may be reduced. Advantageously the cross-reduction improves the fixing of the fastening element with respect to the retaining element in comparison to a retaining component with only fractional engagement with the shank portion of the fastening element. In this case the friction between the retaining element and the shank portion may depend on the material of these both components and tolerances of the inner diameter of the retaining element and the outer diameter of the shank portion.

In an advantageous embodiment the retaining element consists of a plastic or comprises a plastic. This has the advantage that the retaining element can be in secure engagement with the shank portion. The retaining element may be produced in a simple fashion as a perform element.

In a further advantageous embodiment the fastening element comprises a thread with a first thread section in a first area of the shank portion and a second thread section in a second area of the shank portion, wherein an intermediate area between the first and second area is shaped complementarily to the latch area of the retaining element. Preferably the first area and the second area are each arranged directly adjacent to the intermediate area. An inner diameter of the retaining element in the latch area and an axial length of the intermediate area, and preferably an axial length of the latch area, may be chosen so that a sufficient snap impact between the fastening element and the retaining element is possible. Additionally the axial length of the intermediate area may be chosen so that a number of missing thread grooves in the intermediate area does approximately not influence a fixing of the fuel rail to the cylinder head.

In a further advantageous embodiment the retaining element comprises at least one elongate slot in axial direction. The slot may allow for an improved elastic deformation of the retaining element, in particular for an enlargement of the outer diameter of the retaining element during an insertion of the fastening element, and therefore may contribute to a reliable snapping of the fastening element.

In a further advantageous embodiment the coupling device comprises a first spring element, being arranged axially between the head portion and the first surface of the holding fixture, and a second spring element, facing the second surface of the holding fixture and being arrangeable axially between the second surface of the holding fixture and the cylinder head. The coupling of the holding fixture, which can be part of a fuel injector cup, with the cylinder head allows an assembly of the cylinder head and the fuel rail without a direct contact between the cylinder head and the holding fixture.

In a further advantageous embodiment at least one of the spring elements consists of a rubber or comprises a rubber. As at least one of the spring elements consists of a rubber or comprises a rubber, a noise transmission between the cylinder head and the fuel rail can be kept very small. Additionally, the rubber may be selected in view of the desired stiffness of the spring elements in a simple manner so that a favorable dynamic behavior of the fuel rail relative to the cylinder head may be obtained.

In a further advantageous embodiment a distance element is arranged axially between the first spring element and the second spring element.

In a further advantageous embodiment the distance element has a sleeve-like form and is at least partially arranged inside the through hole. The retaining element is directly coupled to the distance element. By this a preset distance between the spring elements may be obtained. Consequently, a preset deformation of the spring elements may be obtained easily. By this a compact construction of the coupling device may be obtained.

In a further advantageous embodiment the distance element comprises at least one collar being arranged axially between the head portion and the first spring element and/or being arrangeable axially between the second spring element and the cylinder head. Due to the at least one collar a preset deformation of the spring element may be obtained.

In a further advantageous embodiment the distance element comprises two collars, the first collar being arranged axially between the head portion and the first spring element and the second collar being arrangeable axially between the second spring element and the cylinder head.

In a further advantageous embodiment the retaining element comprises at least one denticulation element designed and arranged to axially fix the distance element.

In a further advantageous embodiment the fastening element is a screw.

Figure 2:
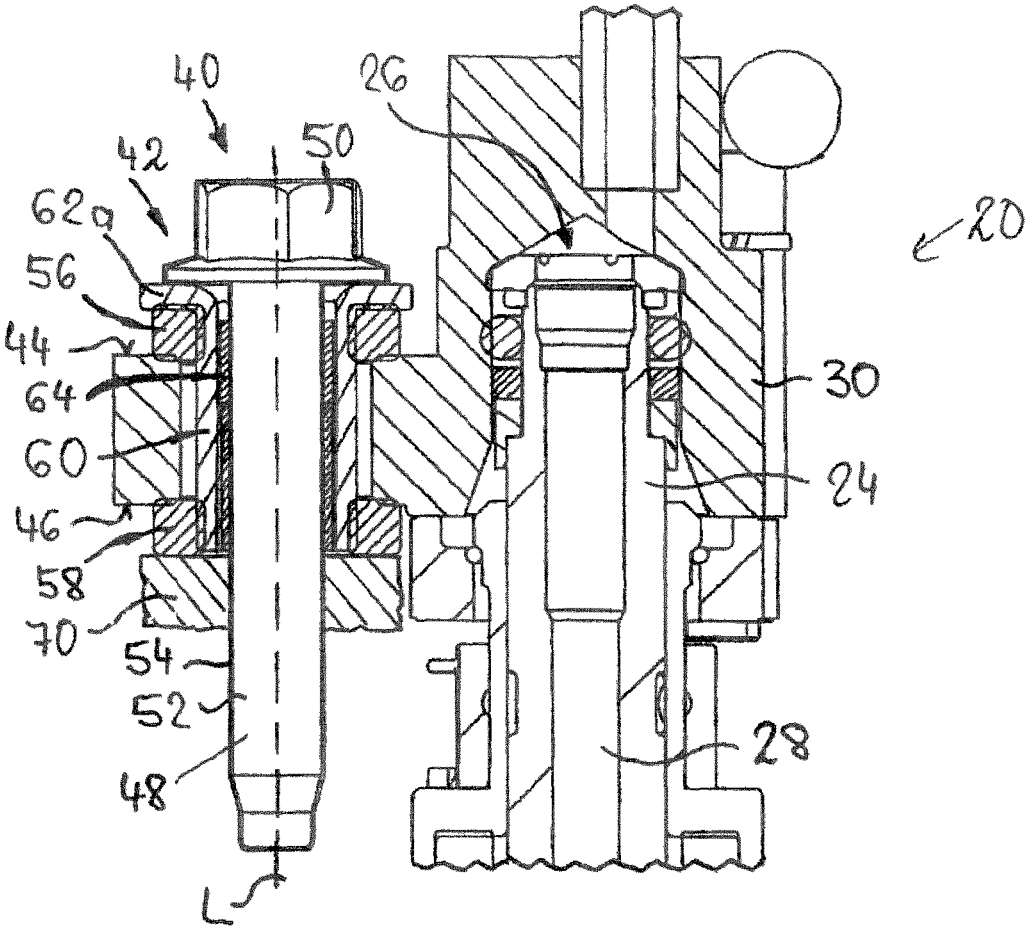
Figure 3:
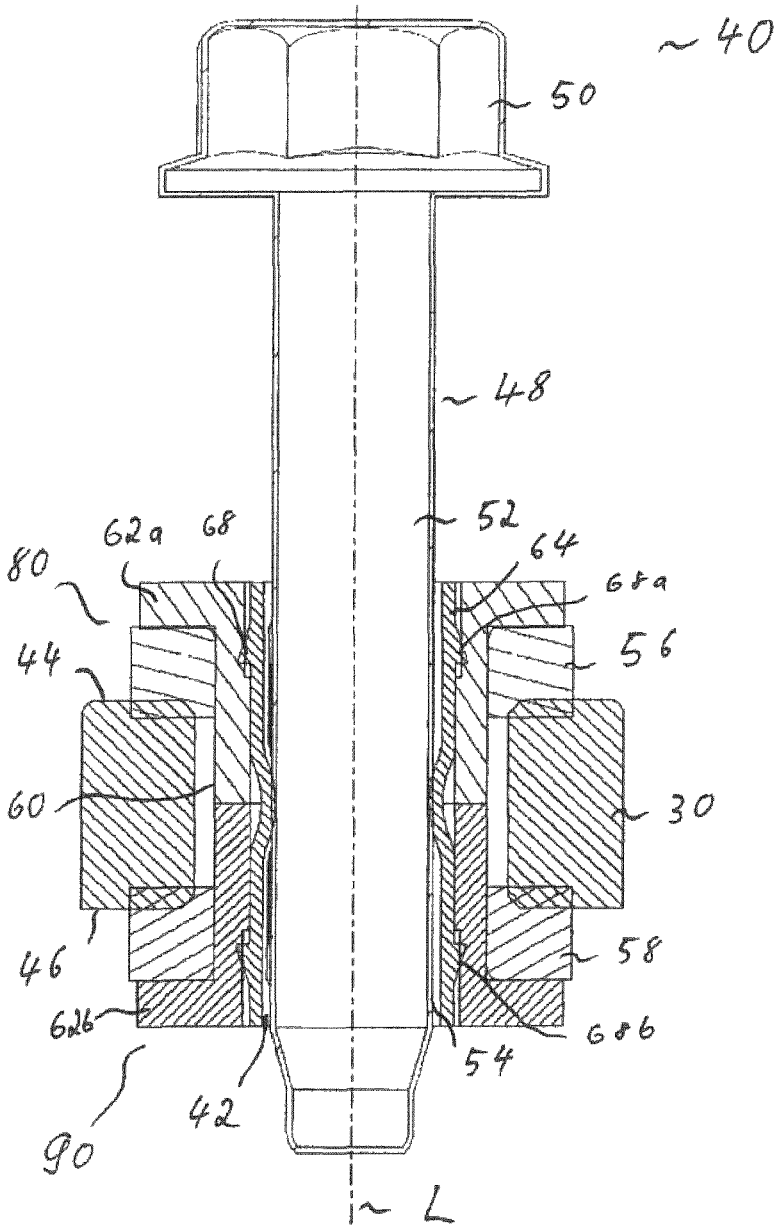
Figure 4:
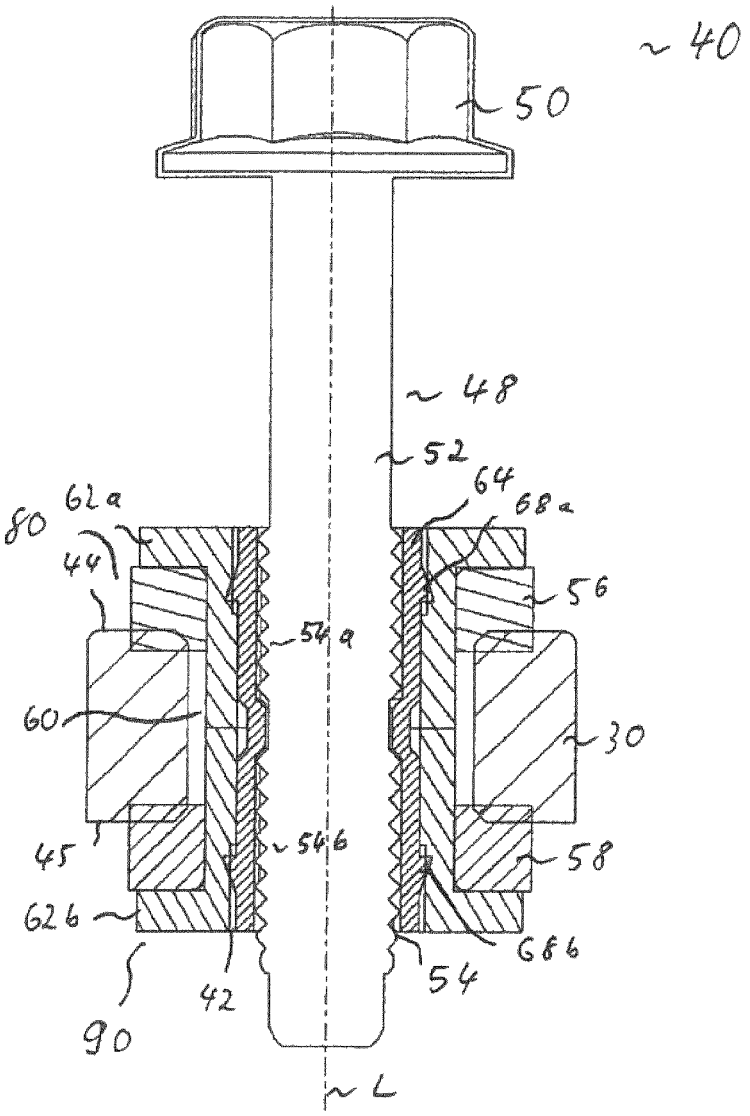
Figure 5:
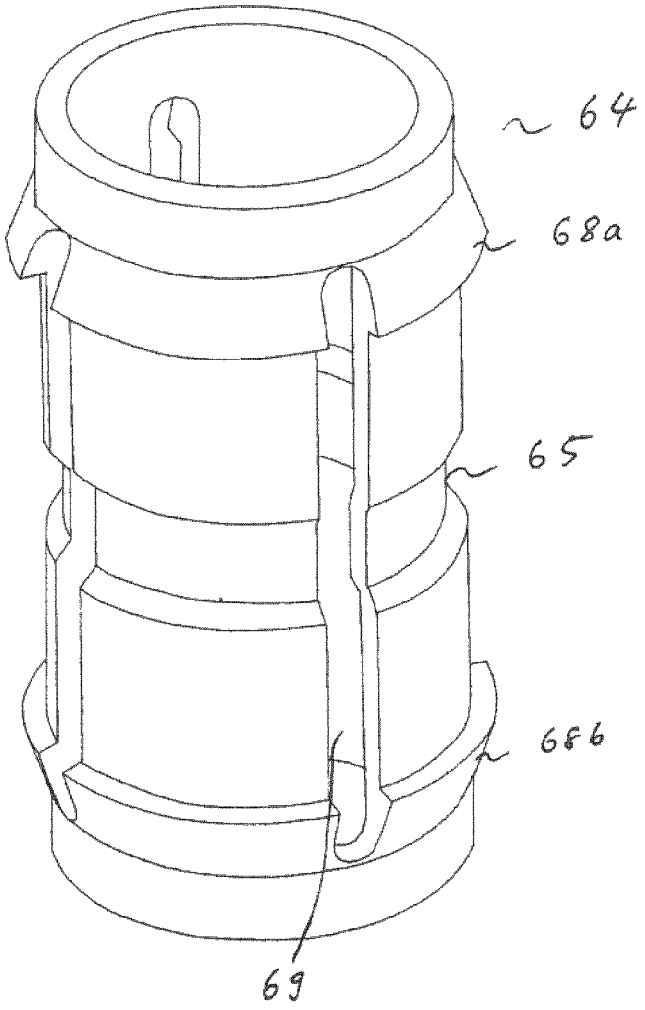

Exemplary embodiments of the invention are explained in the following with the aid of schematic drawings. These are:

FIG. 1 an internal combustion engine in a schematic view,

FIG. 2 a coupling device in a longitudinal sectional view,

FIG. 3 a first embodiment of the coupling device in a longitudinal sectional view, FIG. 4 a second embodiment of the coupling device in a longitudinal sectional view and FIG. 5 embodiment of a retaining element in a schematic view.

Elements of same design and function that occur in different figures are identified by the same reference character.

A fuel feed device 10 is assigned to an internal combustion engine 22 (FIG. 1) which can be a diesel engine or a gasoline engine. It includes a fuel tank 12 that is hydraulically connected with a fuel pump 14. The output of the fuel pump 14 is connected to a fuel inlet 16 of a fuel rail 18. In the fuel rail 18, the fuel is stored for example under a pressure of about 200 bar in the case of a gasoline engine or of about 2,000 bar in the case of a diesel engine. Fuel injectors 20 are connected to the fuel rail 18 and the fuel is fed to the fuel injectors 20 via the fuel rail 18. The fuel injectors 20 are arranged in a cylinder head 70 of the internal combustion engine 22. Preferably, the fuel injectors 20 are not in direct contact with the cylinder head 70.

FIG. 2 shows a part of the fuel injector 20. The fuel injector 20 has a fuel injector body 24. The fuel injector 20 is suitable for injecting fuel into a combustion chamber 25 of the internal combustion engine 22 (FIG. 1). The fuel injector 20 comprises a fuel inlet portion 26. Furthermore, a cavity 28 is arranged in the fuel injector body 24. In an injection mode fuel can flow from the fuel inlet portion 26 to the cavity 28 and can be subsequently injected into the combustion chamber 25. In a non-injecting mode an injection of fuel into the combustion chamber 25 is prevented.

In the embodiment of FIG. 2 the fuel feed device 10 comprises a fuel injector cup 30' with a holding fixture 30 which is part of a coupling device 40. Therefore the fuel injector cup 30' is mechanically and hydraulically coupled to the fuel rail 18. The fuel injector cup 30' is in engagement with the fuel inlet portion 26 of the fuel injector 20.

Alternatively the holding fixture 30 may be a separate component, e. g. a clip collar for mounting the fuel rail 18 to the cylinder head 70. Such a clip collar may comprise an annular body surrounding the fuel rail 18 and flanges. The flanges may comprise e. g. one mounting recesses.

FIG. 3 shows a first embodiment of the coupling device 40 in a detailed sectional view. The holding fixture 30 of the fuel injector cup 30' has a through hole 42 with a central longitudinal axis L. The through hole 42 extends between a first surface 44 and a second surface 46 of the holding fixture 30. The first surface 44 is forming an outer surface of the holding fixture 30. The second surface 46 opposes the first surface 44 and faces the cylinder head 70.

The coupling device 40 further comprises a fastening element 48. The fastening element 48 has a head portion 50 and a shank portion 52. The head portion 50 has a larger radial extension than the shank portion 52. The head portion 50 faces the first surface 44 of the holding fixture 30. Preferably, the fastening element 48 is a screw with an outer thread 54. The shank portion 52 is extending through the through hole 42. The shank portion 52 can be in engagement with the cylinder head 70. If the fastening element 48 is a screw, the outer thread 54 is in engagement with an inner thread which is arranged in the cylinder head 70. By this the fastening element 48 can be fixedly coupled to the cylinder head 70.

In addition the coupling device 40 comprises a retaining element 64 being arranged inside the through hole 42, being coupled with the holding fixture 30, comprising in a given latch area 65 a cross-section restriction and being in engagement with the shank portion 52 at least in this latch area 65. The retaining element 64 is formed as a one-piece unit. The retaining element 64 may consist of a plastic or may comprise a plastic. Furthermore the retaining element 64 may comprise at least one elongate slot 69 in axial direction.

An axial length of the retaining element 64 may be chosen so that an inclination of the fastening element 48 may approximately be avoided. The retaining element 64 may be configured symmetrically in respect to a first and a second end of the retaining element 64 allowing for inserting the retaining element 64 from both sides of the through hole 42 without affecting the effectiveness of the retaining element 64.

The coupling device 40 may further comprise a first spring element 56 and a second spring element 58. The spring elements 56, 58 consist of a rubber or comprise a rubber. Depending on the axial extension and the shape of the spring elements 56, 58 and the type of rubber used for the spring elements 56, 58 a desired stiffness of the spring elements 56, 58 can be selected. The first spring element 56 is arranged axially between the head portion 50 and the first surface 44 of the holding fixture 30. The second spring element 58 faces the second surface 46 of the holding fixture 30. The second spring element 58 is arranged axially between the second surface 46 of the holding fixture 30 and the cylinder head 70.

The coupling device 40 comprises a distance element 60 which has the shape of a sleeve. The distance element 60 is arranged axially between the first spring element 56 and the second spring element 58. The distance element 60 enables to maintain a desired distance between the first spring element 56 and the second spring element 58. The distance is selected in a way that the deformation of the spring elements 56, 58 is in a desired range. The distance element 60 is arranged inside the through hole 42. The retaining element 64 and the shank portion 52 are arranged inside the distance element 60.

The distance element 60 may comprise two collars **62*a*, 62*b*. The distance element 60 may has two parts, an upper part 60*a* and a lower part 60*b*, which are separated from each other. The upper part 60*a* of the distance element 60 comprises the first collar 62*a*, the lower part 60*b* of the distance element 60 comprises the second collar 62*b*. The first collar 62*a*** is arranged axially between the head portion 50 and the first spring element 56. The second collar 62*b* is arranged axially between the second spring element 58 and the cylinder head 70. This can make it very easy to mount the fuel injector cup 30' to the cylinder head 70 on the production line.

Alternatively the distance element 60 may comprise one collar 62*a*. The collar 62*a* may be arranged axially between the head portion 50 and the first spring element 56 or between the second spring element 58 and the cylinder head 70. The collar 62*a* allows for obtaining a preset deformation of the spring elements 56, 58. The collar 62*a* which is arranged between the second spring element 58 and the cylinder head 70 can have a larger contact area than the second spring element 58 so that the pressure between the coupling device 40 and the cylinder head 70 can be very low. Therefore, an imprinting into the cylinder head 70 can approximately be avoided.

The retaining element 64 may comprise a first 68*a* and a second denticulation element 68*b* designed and arranged to axially fix the distance element. The first 68*a* and the second denticulation element 68*b* may be each disposed with a given distance from the latch area 65. The first denticulation element 68*a* may be arranged in a first end section of the retaining element 64 and the second denticulation element 68*b* in a second end section.

For a pre-assembly the fastening element 48, the first spring element 56, the upper part 60*a* of the distance element 60 and the retaining element 64 may be composed in a manner that they form a first subassembly 80. In this first subassembly 80 the retaining element 64 is blocked in relation to the fastening element 48. The upper part 60*a* of the distance element 60 can move between the first 68*a* and second denticulation element 68*b* of the retaining element 64. The first spring element 56 may be fixed to the upper part 60*a* of the distance element 60 because of a huge interference.

A second subassembly 90 may consist of the second spring element 58 and the lower part 60*b* of the distance element 60. The pre-mounted subassemblies 80, 90 allow an easy mounting of the holding fixture 30 with the cylinder head 70 on production line. In production the first 80 and second subassembly 90 may be mounted on the holding fixture 30. For simplifying the mounting of the subassemblies 80, 90 to the holding fixture 30 the holding fixture 30 may comprise chamfered edges; in particular edges facing the through hole 42 may be chamfered for an easy mounting from one side and with a 90° angle from the other side.

The presented coupling of the fuel injector cup 30' with the cylinder head 70 enables to mount the holding fixture 30 of the fuel injector cup 30' on the cylinder head 70 without a direct contact between the holding fixture 30 and the cylinder head 70. Consequently, a noise transmission between the cylinder head 70 and the fuel rail 18 can be kept small or even be avoided. The presented coupling device 40 may allow for blocking an axial movement of the distance element 60 and fixing the fastening element 48 in a desired position, also in case of an accidental collision with another environmental component.

FIG. 4 shows a second embodiment of the coupling device 40 in a detailed sectional view. In comparison to the first embodiment in this case the fastening element 48 comprises a thread 54 with a first thread section 54*a* in a first area of the shank portion 52 and a second thread section 54*b* in a second area of the shank portion 52, wherein an intermediate area between the first and second area is shaped complementarily to the latch area 65 of the retaining element 64.

In FIG. 5 an embodiment of the retaining element 64 according to the second embodiment of the coupling device 40 is shown separately. The retaining element 64 according to the first and/or second embodiment of the coupling device 40 may be used also for other applications making use of a bolt blocking device.

The invention claimed is:

1. A coupling device for mechanically coupling a fuel rail to a cylinder head of a combustion engine, the coupling device comprising:

a holding fixture comprising a through hole extending between a first surface and a second surface, the second surface opposing the first surface and arranged to face the cylinder head, a fastening element configured to be fixedly coupled to the cylinder head, the fastening element comprising a head portion and a shank portion, the head portion facing the first surface of the holding fixture, and the shank portion partially arranged in the through hole and configured to engage with the cylinder head, the shank portion with a nominal diameter, a retaining element arranged inside the through hole and coupled with the holding fixture, the retaining element comprising a base inner diameter and in a given latch area a neck having a second inner diameter smaller than the base inner diameter and engaged with the shank portion at least in the latch area, the latch area disposed within the through hole and between the first surface and the second surface of the holding fixture, wherein the retaining element is formed as a resilient one-piece unit removable from the through hole, a first spring element disposed axially between the head portion and the first surface of the holding fixture, a second spring element facing the second surface of the holding fixture and disposed axially between the second surface of the holding fixture and the cylinder head, and a distance element arranged axially between the first spring element and the second spring element and fixing a distance between the first spring element and the second spring element, wherein the retaining element comprises two denticulation elements configured to axially fix the distance element with respect to the fastening element, wherein the fastening element comprises a thread with a first thread section in a first area of the shank portion and a second thread section in a second area of the shank portion, both the first thread section and the second thread section having the same nominal diameter as the shank portion, wherein an intermediate area lacking threads disposed between the first and second area includes a diameter less than the nominal diameter of the shank portion and is shaped complementarily to the neck of the retaining element, and the head portion of the fastening element, when the fastening element is inserted through the through hole of the retaining element, is disposed at a fixed distance from the retaining element by the interface between the neck of the retaining element and the intermediate area of the shank portion of the fastening element.

2. The coupling device of claim 1, wherein the retaining element comprises a plastic.

3. The coupling device of claim 1, wherein the retaining element comprises at least one elongated slot in an axial direction.

4. The coupling device of claim 1, wherein at least one of the spring elements comprises a rubber.

5. The coupling device of claim 4, wherein the retaining element comprises a plastic.

6. The coupling device of claim 1, wherein the distance element has a sleeve-like form and is at least partially arranged inside the through hole, and wherein the retaining element is directly coupled to the distance element.

7. The coupling device of claim 6, wherein the retaining element and the shank portion are arranged inside the distance element.

8. The coupling device of claim 1, wherein the distance element comprises at least one collar arranged axially between the head portion and the first spring element, or arrangeable axially between the second spring element and the cylinder head.

9. The coupling device of claim 1, wherein the distance element comprises two collars, including a first collar arranged such that the first spring element is positioned axially between the first collar and the first surface, and a second collar arranged such that the second spring element is positioned axially between the second collar and the second surface.

10. The coupling device of claim 9, wherein the distance element has two separate parts, one of the two separate parts comprising the first collar and the other part comprising the second collar.

11. The coupling device of claim 1, wherein the fastening element is a screw.

12. The coupling device of claim 1, wherein the retaining element is configured symmetrically with respect to a first end and a second end of the retaining element, such that the retaining element is insertable from opposite sides of the through hole.

13. The coupling device of claim 1, comprising first and second denticulation elements disposed in opposite end sections of the retaining element at a distance from the latch area.

14. The coupling device of claim 1, wherein each of the first and second spring elements comprises a rubber.

15. A coupling device for mechanically coupling a fuel rail to a cylinder head of a combustion engine, the coupling device comprising:

a holding fixture comprising a through hole extending between a first surface and a second surface, the second surface opposing the first surface and arranged to face the cylinder head, a fastening element configured to be fixedly coupled to the cylinder head, the fastening element comprising a head portion and a shank portion, the head portion facing the first surface of the holding fixture, and the shank portion partially arranged in the through hole and configured to engage with the cylinder head, the shank portion having a nominal diameter, a retaining element arranged inside the through hole and coupled with the holding fixture, the retaining element comprising a base inner diameter and in a given latch area a cross-section restriction comprising a second inner diameter smaller than the base inner diameter and smaller than the nominal diameter of the shank portion and engaged with the shank portion at least in the latch area, the latch area disposed within the through hole and between the first surface and the second surface of the holding fixture, wherein the retaining element is formed as a resilient one-piece unit removable from the through hole, a first spring element arranged axially between the head portion and the first surface of the holding fixture, a second spring element facing the second surface of the holding fixture and arrangeable axially between the second surface of the holding fixture and the cylinder head, and a distance element arranged axially between the first spring element and the second spring element and fixing a distance between the first spring element and the second spring element, wherein the retaining element comprises at least one denticulation element configured to axially fix the retaining element relative to the distance element, and the head portion of the fastening element, when the fastening element is inserted through the through hole of the retaining element, is disposed at a fixed distance from the retaining element by the interface between the neck of the retaining element and the intermediate area of the shank portion of the fastening element.

* * * * *